US005376865A

United States Patent [19]

Adler

[11] Patent Number: 5,376,865

[45] Date of Patent: Dec. 27, 1994

[54] NON-LINEAR YOKE ASSEMBLY AND CATHODE RAY TUBE SYSTEM FOR CORRECTION OF IMAGE GEOMETRICAL DISTORTIONS

[75] Inventor: Robert Adler, Northfield, Ill.

[73] Assignee: Zenith Electronics Corporation, Glenview, Ill.

[21] Appl. No.: 864,928

[22] Filed: Apr. 7, 1992

Related U.S. Application Data

[63] Continuation-in-part of Ser. No. 559,227, Jul. 27, 1990, abandoned.

[51] Int. Cl.[5] ..... H01J 29/66

[52] U.S. Cl. ..... 315/370; 315/400; 313/413; 335/211; 335/213

[58] Field of Search ..... 315/370, 400; 313/413; 335/211, 213

[56] References Cited

U.S. PATENT DOCUMENTS

| | | | |
|---|---|---|---|
| 3,706,908 | 12/1972 | Petri . | |
| 3,940,662 | 2/1976 | Quirke | 315/400 |
| 3,950,671 | 4/1976 | Ichigaya et al. | 315/370 |
| 4,152,684 | 5/1979 | Heijnemans et al. | 335/213 |
| 4,451,807 | 5/1984 | McGlashan et al. | 335/211 |
| 4,794,300 | 12/1988 | Beelaard et al. | 313/440 |
| 4,972,519 | 11/1990 | Grote | 313/440 |
| 5,121,028 | 6/1992 | Milili | 313/440 |
| 5,182,487 | 1/1993 | Ohtsu | 313/440 |

*Primary Examiner*—Theodore M. Blum

[57] ABSTRACT

An improved cathode ray tube yoke assembly and cathode ray tube system is capable of reducing or eliminating cathode ray tube geometrical image distortions caused by an inherent non-linear relationship between magnetic deflection fields inside the tube and electron beam spot deflection. The yoke assembly comprises horizontal and vertical windings for producing horizontal and vertical deflection fields and one or more non-linear magnetic elements. The magnetic elements produce a non-linear relationship between driving currents and magnetic deflection fields inside the tube which substantially compensates for the inherent non-linear relationship between deflection fields and electron beam spot deflection. In the preferred embodiment, the inductances of the yoke windings remain constant during operation.

92 Claims, 10 Drawing Sheets

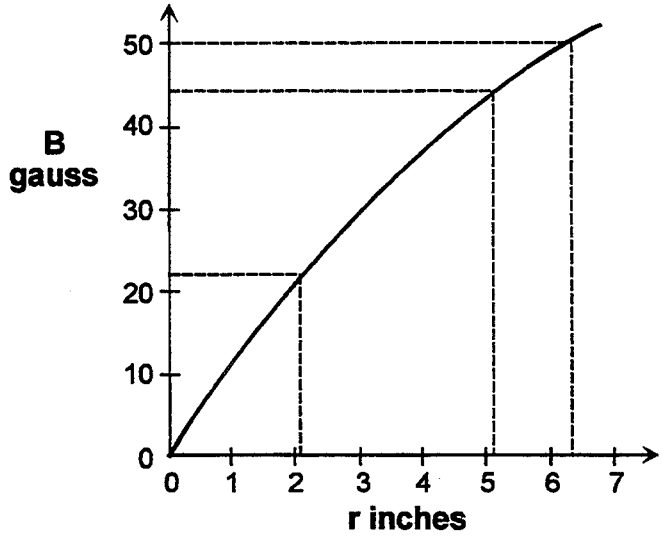
Fig. 4
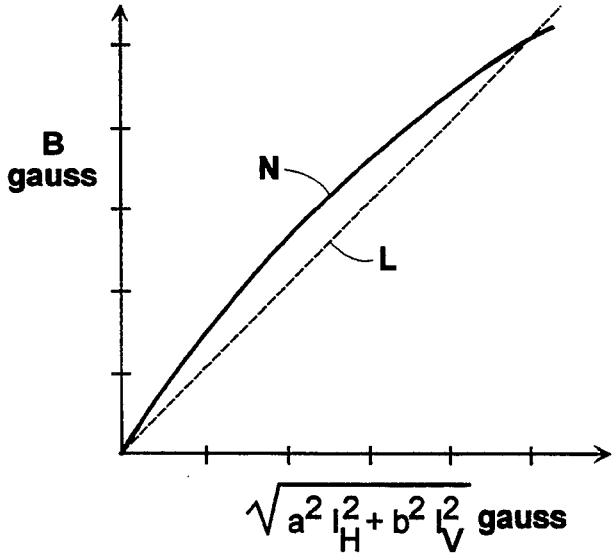
Fig. 5
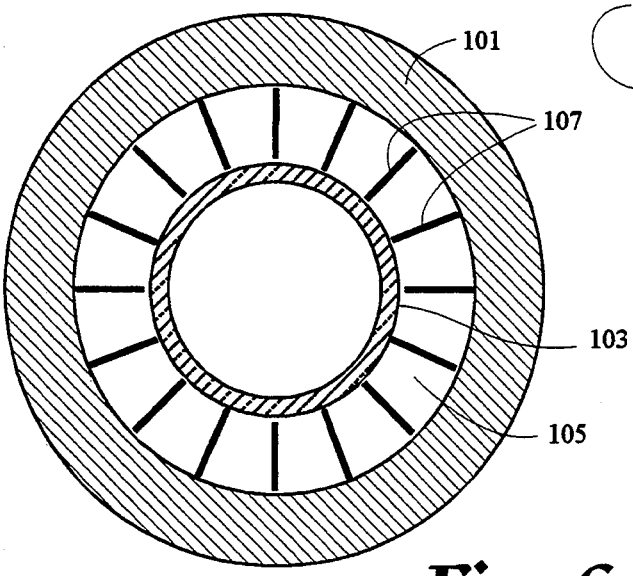
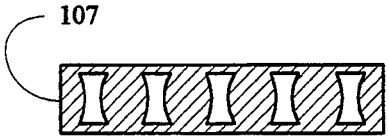
Fig. 6B
Fig. 6A

NON-LINEAR YOKE ASSEMBLY AND CATHODE RAY TUBE SYSTEM FOR CORRECTION OF IMAGE GEOMETRICAL DISTORTIONS

CROSS-REFERENCE TO RELATED PATENT APPLICATION

This application is a continuation-in-part of application Ser. No. 559,227, Filed Jul. 27, 1990, now abandoned.

BACKGROUND OF THE INVENTION

When cathode ray tubes are used to display images, certain well-known geometrical distortions arise which must be compensated for in order for the images to be acceptable. Pincushion distortion causes the straight edges of the nominally rectangular image area to become concave with the four corners displaced outwards. S-distortion causes objects in the peripheral portion of the image to be magnified relative to similar objects in the central portion. Pincushion and S-distortion arise from a common cause; when an electron beam in a cathode ray tube is deflected by a changing magnetic field, the distance along the screen which the point of electron impact travels is not proportional to the magnetic field but increases in a superlinear manner with increasing angle of deflection.

Two factors are involved in producing this lack of proportionality. The first is the fact that the more the beam is deflected., the longer it remains within the yoke; therefore, the deflection angle increases in a superlinear manner with field intensity. The second is the relationship between screen radius and throw distance. If the screen were a sphere whose center coincided with the center of deflection, spot travel would be proportional to deflection angle. But practical screens have longer radii, with the result that spot travel is superlinear with respect to deflection angle, compounding the error produced by the first factor. If the screen is flat, spot travel is proportional to the tangent of the deflection angle, neglecting the forward movement of the center of deflection which is generally small.

FIG. 1 illustrates these relationships for the case of a maximum horizontal deflection angle of plus and minus 39 degrees and a flat screen. Maximum horizontal deflection requires a magnetic field in the deflection yoke which may, for example, be 44 gauss. In this condition, the electron spot appears at the right end of the horizontal axis (point E in FIG. 1), spaced one-half the length of that axis or 5.6 inches on a 14 inch screen from the center C of the viewing area.

If the magnetic field is now reduced to 22 gauss, i.e. one-half of its former value, the deflection angle decreases to 18 degrees, i.e. less than one-half of the original 39 degrees. The electron spot moves inward to position D, spaced only 2.30 inches from the center C; one-half the distance to point E would be 2.80 inches. This non-linear behavior with respect to the magnetic deflection field is duplicated on the left side of the screen, as indicated in FIG. 1 by points E' and D'.

FIG. 2 shows the same screen in plan view and includes an additional point P in the upper right corner. To place the electron spot into position P, a 40 gauss field for horizontal deflection and a 30 gauss field for vertical deflection must be present simultaneously. For comparison, the field needed to place the electron spot at E, directly below P, is 44 gauss. This is not the same as the 40 gauss component required for horizontal deflection in the presence of an orthogonal component of 30 gauss needed to place the spot at P. Evidently, horizontal and vertical non-linearity effects are interdependent. Conventional deflection circuits take account of this interdependence; for example, in the horizontal deflection system, not only is the basically linear sawtooth waveform of the yoke current modified to correct for S-distortion, but the amount of that correction as well as the overall amplitude of the sawtooth are modulated with a parabola at the vertical scanning rate so as to compensate for the above-mentioned interdependence. Similar corrections are imposed upon the vertical waveform. The circuits needed to generate these complex waveforms are costly and require critical adjustments; in addition, modulating and predistorting the horizontal scanning waveform involves the handling of considerable power.

These remarks apply fully to deflection yokes that produce uniform magnetic fields. So called self-convergent yokes, designed to produce astigmatic fields, tend to reduce the need for correction of the vertical waveform and in some cases make such correction unnecessary. At the same time, however, the required corrections for the horizontal waveform become even larger. In all cases, the need for corrections with respect to both horizontal and vertical waveforms increases with cathode ray tubes having a flat screen, thereby burdening this highly desirable tube design with more costly deflection circuits.

OBJECTS OF THE INVENTION

It is an object of this invention to reduce or eliminate geometrical distortions of the image produced by a cathode ray tube by establishing a non-linear relationship between the magnetic deflection fields inside the tube and the horizontal and vertical deflection currents used to produce such fields.

It is another object of this invention to utilize the non-linear magnetic properties of magnetic materials to achieve the aforesaid non-linear relationship.

It is a further object of this invention to modify the non-linear magnetic properties of certain magnetic members by biasing them to saturation, using permanent magnets.

The invention contemplates two different ways of using non-linear magnetic properties. Following one approach, a high-permeability member saturates when the applied field exceeds a certain threshold, thereby slowing the rate of further flux increase in the tube (analogous to an increasing series resistance); following the other approach, a high-permeability element presaturated by a permanent magnet is driven out of saturation when the applied field exceeds a certain threshold, thereby diverting flux from the tube (analogous to an increasing shunt conductance).

It is an additional object of this invention to combine these two approaches in such a way that they cooperate with respect to producing the desired non-linear relationship, while their effect on the inductance of the deflection windings tends to cancel.

It is yet another object of this invention to provide means for reducing or eliminating the effects on electron beam trajectories of stray fields and deflection field non-uniformity created by aforesaid shunt conductance.

It is another object to provide means for equalizing the effects of the aforesaid series relectuance means on the horizontal and vertical deflection fields in applications wherein the horizontal and vertical deflection windings are not equally influenced by the series reluctance means.

DESCRIPTION OF THE FIGURES

FIG. 4 shows the functional relationship B(r) for a cathode ray tube having a flat screen;

FIG. 5 illustrates the non-linear relationship between the magnetomotive force produced by the currents in the deflection windings and the flux density inside the yoke introduced by the magnetic means of the present invention;

FIGS. 6A and 6B illustrate a first embodiment of the invention utilizing series reluctance means;

DESCRIPTION OF THE PREFERRED EMBODIMENTS

Figure 1:
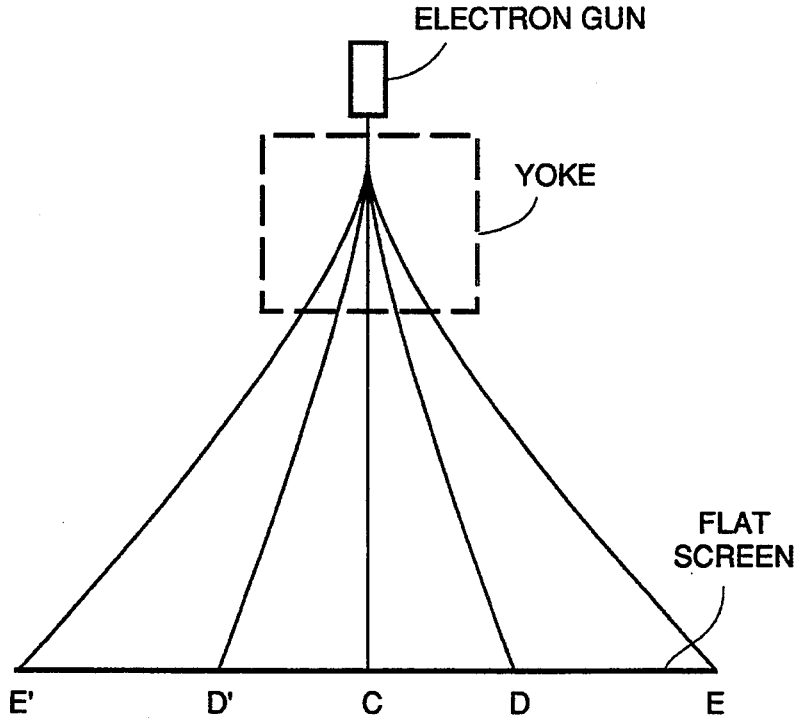
FIGS. 1 and 2 illustrate the basis for the inherent non-linearity between electron spot travel and deflection field intensity in a cathode ray tube.
Figure 2:
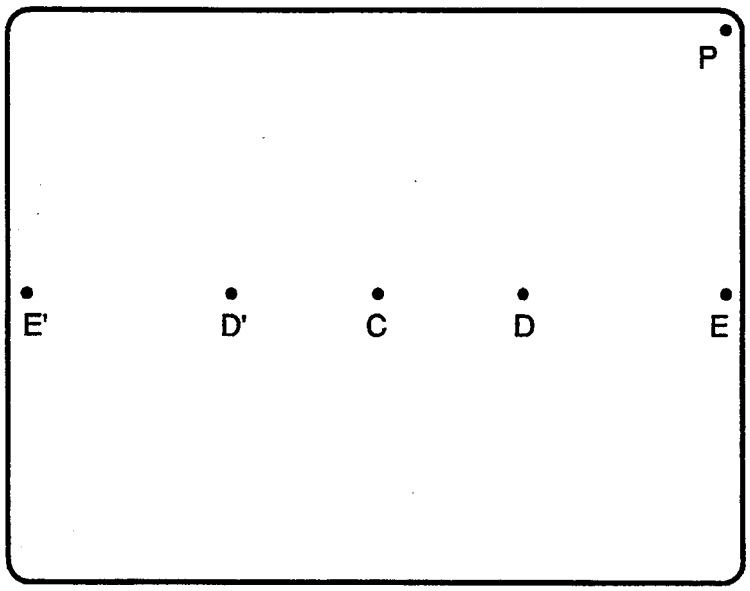
Figure 2A:
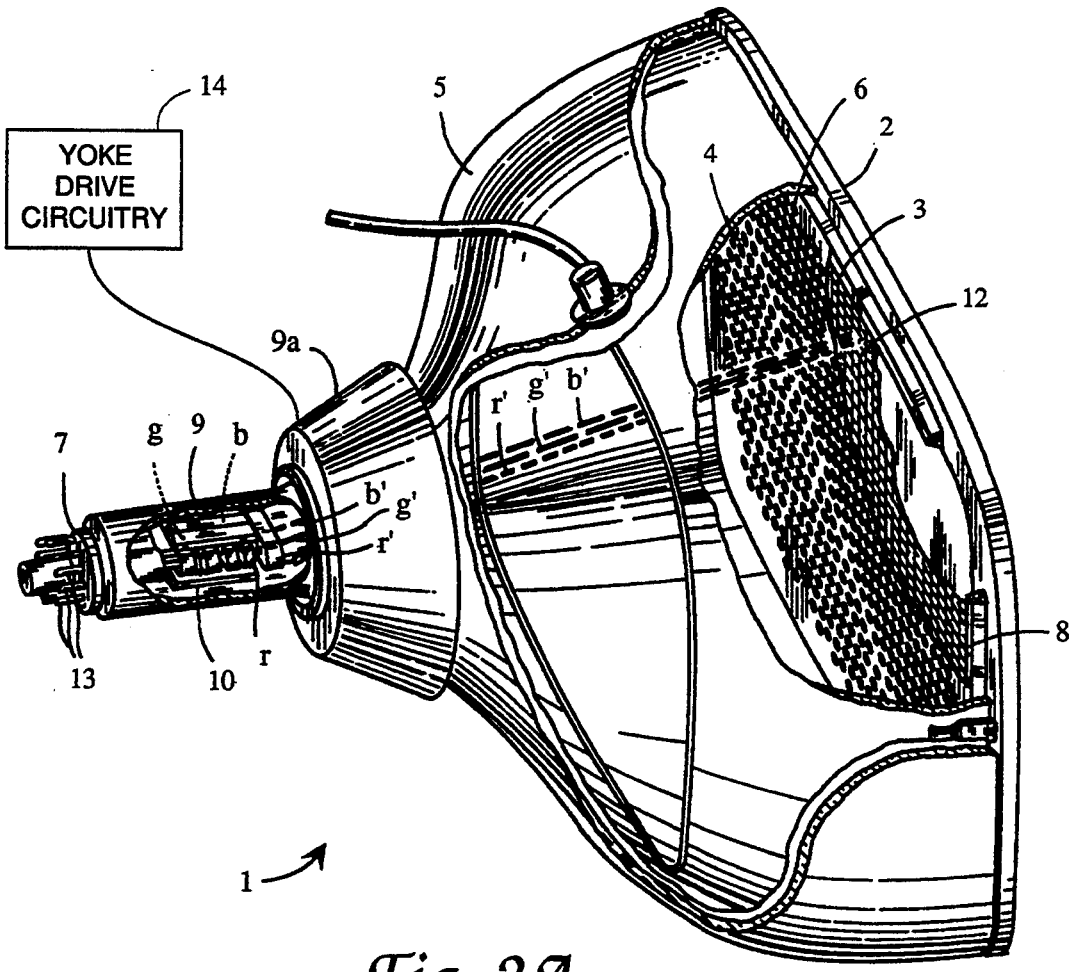
FIG. 2A illustrates a cathode ray tube system embodying the teachings of the present invention.

FIG. 2A illustrates a cathode ray tube system embodying the present invention. FIG. 2A depicts a flat tension mask color cathode ray tube 1 including a glass front panel 2 hermetically sealed to an evacuated envelope 5 extending to a neck 9 and terminating in a connection plug 7 having a plurality of stem pins 13.

Internal parts include a mask support structure 3 permanently attached to the inner surface 8 of the panel 2 which supports a tension shadow mask 4. On the inner surface 8 of the panel 2 is deposited a screen 12 comprising a black grille, and a pattern of colored-light-emitting phosphors distributed across the expanse of the inner surface 8 within the inner boundaries of the support structure 3. The phosphors 12, when excited by the impingement of an electron beam, emit red, green and blue colored light.

The shadow mask 4 has a large number of beam-passing apertures 6, and is permanently affixed as by laser welding to the support structure 3.

In the neck 9 of tube 1 there is installed a cluster 10 of three electron guns identified as r, g and b. The electron guns emit three separate electron beams designated as r', g' and b' directed toward the mask 4. The electron beams are electronically modulated in accordance with color picture signal information.

The improved yoke assembly 9a constructed in accordance with this invention produces horizontal and vertical magnetic fields which cause the electron beams r', g', and b' to scan horizontally and vertically such that the entire surface of the mask 4 is swept in a periodic fashion to form an image extending over substantially the entire area of the screen 12, yoke drive circuitry, shown schematically at 14, supplies deflection currents to the horizontal and vertical deflection windings.

As will now be described in detail, the improved yoke assembly 9a embodies the teachings of the present invention and corrects for inherent geometrical image distortions without the need for special pincushion correction circuits or other non-linear drive circuit interventions.

Figure 3:
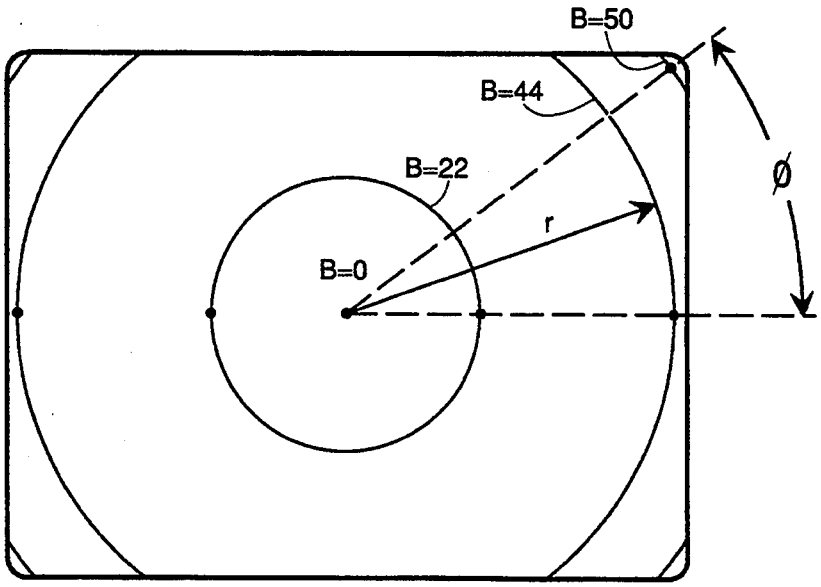
FIG. 3 illustrates the loci of an electron spot for four different magnitudes of the resultant deflection field B.

In the following it will be assumed, for the purpose of simplifying the analysis, that the yoke assembly whose raster distortions are to be corrected is not of the self-convergent type but produces uniform deflection fields. At a given instant, the field produced by the horizontal deflection winding may be $B_H$ (as is well understood, the flux lines of $B_H$ are vertical) and the field generated by the vertical deflection winding may be $B_V$ (its flux lines are horizontal). The two orthogonal fields combine to form a resultant uniform field $B=\sqrt{B_H^2+B_V^2}$, capable of deflecting the electron beam away from the screen center under an angle $\phi$ to the horizontal given by $\tan \phi=B_V/B_H$, by an amount which depends only on B but not on $\phi$. This is illustrated in FIG. 3, which shows the loci of the electron spot for four different magnitudes of the resultant field B. These loci are concentric circles whose radius "r" bears a non-linear relationship to the field B. FIG. 4 shows the functional relationship B(r) for a 14 inch tube with a flat screen. For a given r, B remains the same regardless of $\phi$, even though the two components of B, namely $B_H$ and $B_V$, vary widely as $\phi$ is changed.

The invention takes advantage of the fact that when the position of the electron spot is expressed in terms of polar coordinates r and $\phi$ rather than in terms of horizontal and vertical deflection, only one coordinate, namely r, shows a non-linear dependence on the magnetic field. To utilize this fact, non-linear corrections are applied to the magnitude of the resultant field B rather than to its components $B_H$ and $B_V$ individually; the amount of the correction is a function of B only, and the correction has no effect on $\phi$.

Normally, the relationship between the current in the deflection winding and the magnetic field produced thereby is linear. According to the invention, non-linear magnetic members are introduced into the flux path of the deflection windings to produce a non-linear relationship such as the one illustrated in FIG. 5 (curve N). The two constants "a" and "b" appearing in that figure depend on the size and the number of turns of the two windings and were chosen so that in the absence of the inventive device, $aI_H=B_H$ and $bI_v=B_v$, where $I_H$ and $I_v$ are the currents in the respective windings. Under these conditions, the functional relationship shown in FIG. 5 would be a straight line under 45 degrees (line L). When the inventive device is introduced, the relationship becomes non-linear. It is evident that if the solid curve N shown in FIG. 5 can be made to coincide with the B(r) curve of FIG. 4, "r" will become linear with respect to $\sqrt{a^2I_H^2+b^2I_v^2}$. Since $\phi$ is not affected by these corrections, raster distortion will have been eliminated over the entire screen.

To achieve the desired non-linear corrections, the invention uses the well known saturating characteristics of soft magnetic materials such as silicon steel, high permeability nickel alloys, nickel-zinc or manganese-zinc ferrite, etc. to produce a field-intensity-dependent reluctance. These characteristics are put to use in two different ways which are explained in the following.

FIGS. 6A and 6B illustrate the first or series reluctance form of the invention. In FIG. 6A, 101 represents a conventional uniform field yoke having an inside diameter somewhat larger than the outside diameter of the tube neck 103, so that an annular space 105 is left between neck and yoke. Within this space there are numerous thin radial vanes 107 made of a soft magnetic material which saturates at relatively low flux density, for example, manganese ferrite.

At a particular instant, currents $I_H$ and $I_v$ flow in the yoke windings. If vanes 107 were absent, these currents would generate a resultant field B. Actually, because the vanes are present and have high permeability, the field B′ inside neck 103 is larger than B. Because of the large number of vanes and the circular symmetry of the arrangement, the magnification factor B′/B is the same regardless of the angle $\phi$ of the field, and $\phi$ is preserved in the process of magnification.

If, however, B exceeds a certain value, those vanes most closely aligned with the field begin to saturate. As a consequence, the magnification factor B′/B decreases, dropping eventually to unity at high yoke currents. This is the desired non-linear behavior; it is independent of $\phi$ and depends only on B, the Shape and number of the vanes and their magnetic properties.

It is desirable that the drop in the ratio B′/B with increasing B be gradual rather than abrupt. Certain factors inherent in the arrangement, such as the different angles presented by different vanes to a particular field, ensure that the transition will not be abrupt. However, it is within the scope of the invention to tailor the vanes by varying their shape (thickness or radial length) or by using combinations of magnetic materials so that saturation is approached more gradually.

Because of their high permeability, the vanes concentrate the external flux; this concentrating action allows them to saturate in a relatively weak external field such as, for example, 30 gauss. However, saturation requires that the vanes have a very small cross-section. This is achieved, first, by making them thin; in addition, the flux-carrying width may be reduced to a fraction of the total width as shown in the example of FIG. 6B.

Figure 7:
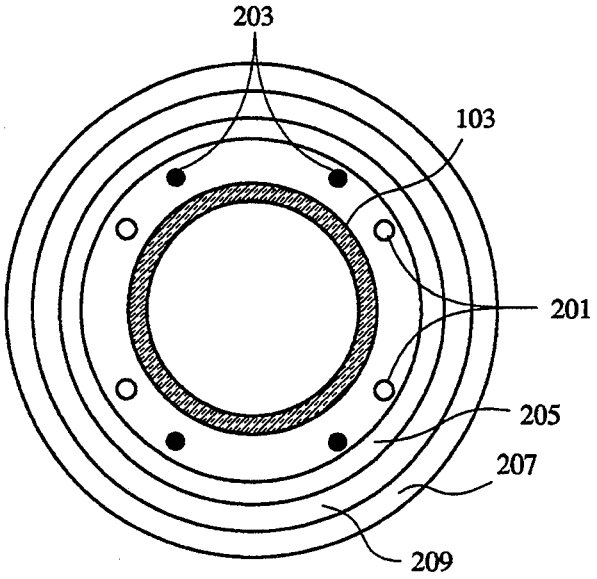
FIG. 7 shows an alternative arrangement of the invention which also utilizes series reluctance means.

It will be recognized that the essence of this form of the invention is to provide a circularly symmetrical reluctance element in series with the yoke field. In the arrangement of FIG. 6A, vanes 107 provide this series reluctance. FIG. 7 shows an alternative arrangement. In most respects, this is a conventional saddle-saddle yoke assembly, with horizontal deflection windings 201 and vertical deflection windings 203 (only the central turns are indicated) arranged inside an annular ferrite core. The novel part of the arrangement is the fact that the ferrite core consists of two concentric annular pieces 205 and 207 separated by an annular air gap 209 which may contain non-magnetic material. As will be understood, the annular ferrite core serves to return the flux generated by the deflection coils inside the yoke; its reluctance is therefore in series with the reluctance of the space inside the yoke. Normally, the cross-section of the core is made large enough to render its reluctance negligible. According to the invention, however, the inner core 205 does not have sufficient radial thickness to accommodate the return flux during periods of high deflection currents; during such periods, a portion of the return flux leaks out of the inner core to return through the outer core 207. To do so, the flux must cross air gap 209 which constitutes an additional reluctance.

Again, because of the circular symmetry of the two cores 205 and 207 and intervening air gap 209, the non-linear relationship between the magnetomotive force produced by the currents in the deflection windings and the flux density inside the yoke is the same regardless of the angle $\phi$ of the field.

Figure 8:
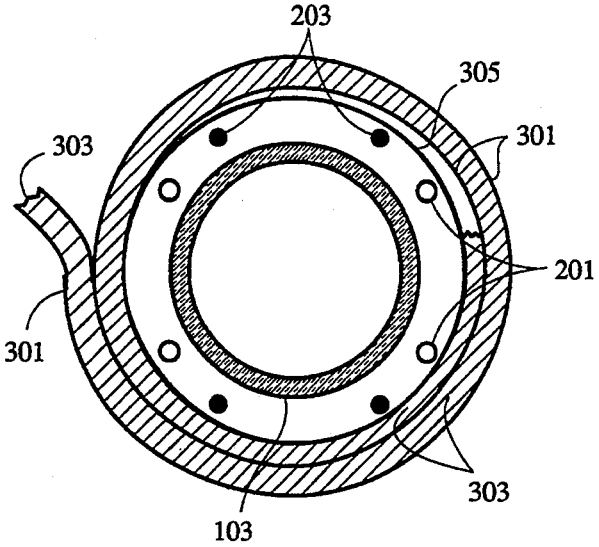
FIG. 8 schematically depicts a third arrangement for utilizing a series reluctance to produce the aforedescribed non-linear relationship.

To obtain the desired gradual onset of saturation, the core may be split into more than two annular portions separated by more than one air gap. FIG. 8 shows a variation in which a continuous spiral 301 of soft magnetic material is interwound with a spiral 303 of non-magnetic material. This combination operates in a manner equivalent to several concentric rings of soft magnetic materials spaced from each other by air gaps. A solid ring 305 of soft magnetic material, too thin to carry the maximum return flux, may be positioned inside the spiral winding if desired in order to delay the onset of non-linearity. While the spiral winding, strictly speaking, does not have perfect circular symmetry, in practice the,approximation is good enough.

A yoke constructed according to FIGS. 6A, 7 or 8 is capable of eliminating pincushion and S-distortion when linear sawtooth currents are applied to its windings. Conventional horizontal deflection circuits, however, will generate a linear sawtooth current only when working into a fixed inductance load. Conventional yokes do indeed have fixed inductance; but the inductance of a yoke constructed according to FIGS. 6A, 7 or 8 decreases when part of the flux path saturates and the extra series reluctance comes into play. Therefore, if the horizontal winding of such a yoke is to be driven from a conventional horizontal deflection circuit, it may be desirable to compensate for the inductance variation as explained in the following.

Figure 9:
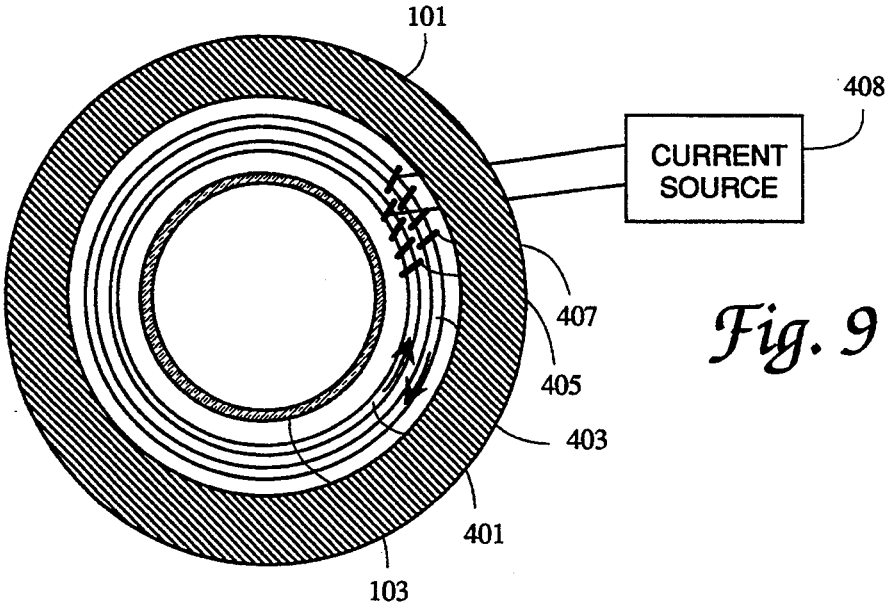
FIGS. 9, 10A and 10B illustrate an alternative execution of the teachings of the invention employing a shunt magnetic conductance to achieve the objectives of the invention.

FIG. 9 illustrates the second or shunt reluctance form of the invention. It shows a conventional uniform field yoke 101 arranged concentrically around tube neck 103 with some radial clearance between the two. Arranged concentrically within that annular space are two thin-walled hollow cylinders 401 and 403 made of high-permeability material. Inner cylinder 401 carries a toroid winding 405 and outer cylinder 403 carries a similar winding 407. Both toroids are connected to an external source of direct current 408.

The d.c. currents through the two toroids are so adjusted that in the absence of deflection currents in yoke 101, both cylinders 401 and 403 are magnetically saturated, with the flux traveling in opposing direction as indicated by the two arrows. In the saturated condition the permeability of the cylinders is very low; consequently, so long as the external field $B_{ext}$ produced by currents in the deflection winding is small, the cylinders have no significant effect, and the deflection field B″ inside tube neck 103 remains essentially equal to $B_{ext}$.

Figure 10A:
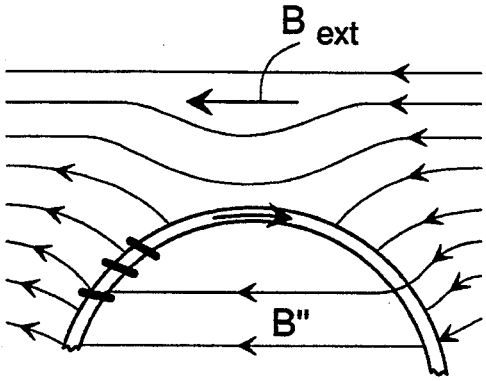

However, when the external field $B_{ext}$ is increased, portions of both cylinders 401 and 403 are forced out of saturation. This process is illustrated schematically in FIG. 10A which shows a short portion of one cylinder in the presence of an externally applied field $B_{ext}$.

Figure 10B:
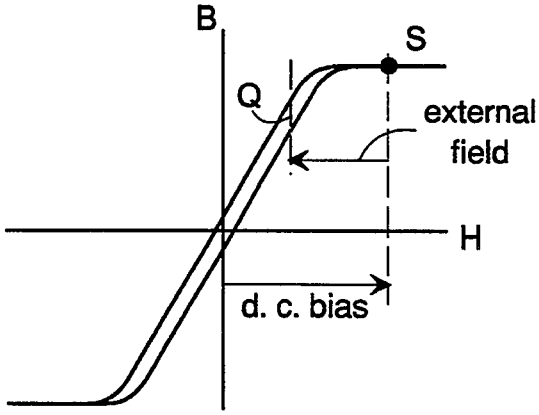

The d.c. flux in the illustrated portion has a direction opposite to that of $B_{ext}$. Without $B_{ext}$ being present, the direct current would bias the entire cylinder to point S on the magnetization curve (FIG. 10B); but with $B_{ext}$ applied, some opposing field leaks into the cylinder and drives the illustrated portion into region Q where permeability is high. A corresponding process occurs in the oppositely biased cylinder on the opposite side of the tube neck. As a consequence of the partial desaturation of cylinders 401 and 403, a portion of the flux produced by the deflection windings is now shunted through the desaturated portions of those cylinders, bypassing the space inside the neck. The field B″ inside the neck therefore becomes smaller than $B_{ext}$ whenever the deflection field is large enough. Again, because of the circular symmetry of the arrangement, the ratio $B''/B_{ext}$ depends only on $B_{ext}$ and is independent of the orientation angle $\phi$.

The d.c. current in windings 405, 407 could be adjusted in order to optimize the non-linearity.

Figure 11:
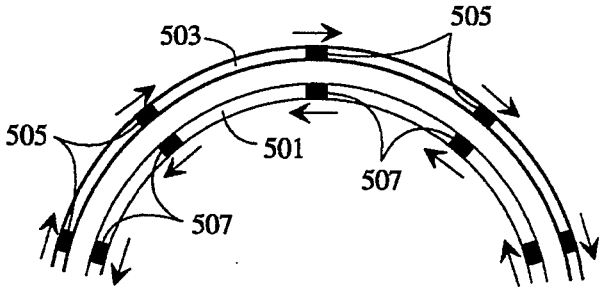
FIG. 11 illustrates an alternative to the FIG. 9 embodiment utilizing permanent magnets.

The toroid windings on cylinders 401 and 403 may be replaced by permanent magnets, as shown in FIG. 11. Here, all magnets are poled clockwise (505) in one cylinder and counterclockwise (507) in the other. This modification requires magnets whose residual (remanent) flux density is slightly higher than the saturation flux density of the intervening high permeability pieces 501 and 503 respectively, which may typically be made of manganese ferrite. Circular symmetry is retained to a sufficiently close approximation by making the number of magnets in each cylinder sufficiently large.

Figure 12A:
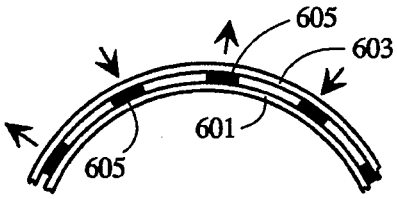
FIGS. 12A and 12B illustrate yet another embodiment of the invention utilizing a shunt magnetic conductance means.
Figure 12B:
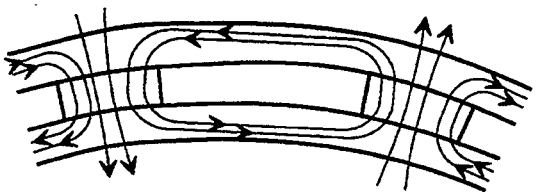

FIG. 12A shows another embodiment of the shunt reluctance form of the invention. Here, two thin continuous cylinders 601 and 603 made of high-permeability material such as manganese ferrite are arranged concentrically with a small gap between them; flat, thin permanent magnets 605 are inserted into the gap, magnetized radially with alternating polarity. FIG. 12B shows the paths of the biasing flux. This structure has the advantage of great design flexibility, since magnet materials having a wide range of remanent flux density can be accommodated by varying magnet width. A further advantage is the complete symmetry between the two flux directions. There is no outer cylinder with clockwise flux and inner cylinder with counterclockwise flux; rather, clockwise as well as counterclockwise flux switch back and forth between the outer and inner cylinders at each permanent magnet. Circular symmetry is retained to a sufficiently close approximation by making the number of magnets sufficiently large, for example, 24.

A yoke constructed according to FIGS. 9, 11 or 12A is capable of eliminating pincushion and S-distortion when linear sawtooth currents are applied to its deflection windings. However, the inductance of such a yoke increases when portions of cylinders 401, 403, 501, 503, or 601, 603 are forced out of saturation by large deflection currents, so that the shunt reluctance of the cylinders comes into play. Therefore, if the horizontal winding of such a yoke is driven from conventional horizontal deflection circuit designed to work with a yoke of constant inductance, the non-linearity of B″ with respect to $B_{ext}$ will be enhanced by the rise of inductance with increasing field. Under some conditions this may be desirable; however, it must be kept in mind that this enhancement of non-linearity is limited to the horizontal deflection, since vertical deflection current in conventional circuits is little affected by inductance.

In the operation of the shunt reluctance device depicted in FIG. 12A, an effect has occasionally been observed: along the outer edges of the rectangular raster displayed on the screen, some electron beams are slightly defocused and the edges themselves appear wavy rather than straight. This disturbance affects primarily the red beam along one vertical edge and the blue beam along the other, so that convergence along the edges is also impaired.

The effect has been traced to the stray field of radial magnets 605. This field extends to the inside of high-permeability cylinder 601. Calculation shows that on the inside of a circular structure comprising n magnet pairs, the intensity of the stray field decreases in proportion to the (n-1)th power of the radius; thus if there are 24 magnets in the structure depicted in FIG. 12A, the internal stray field is proportional to the 11th power of the radius. It therefore decreases very rapidly toward the center.

Nevertheless, at the extreme right and left positions in the raster, one or the other of the two outside electron beams comes close enough to the glass envelope and thus to the magnets 601 for the effects of the stray field to become noticeable.

Figure 12C:
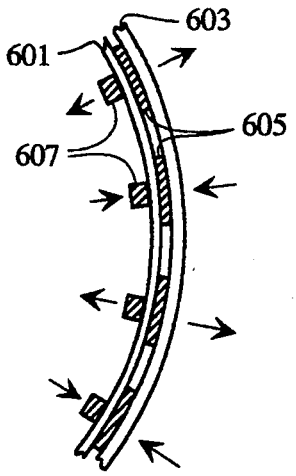
FIGS. 12C–12E and 12F–12H illustrate additional embodiments of the invention.

It has been found that the addition of smaller radial magnets, attached to the inside of cylinder 601, aligned with the original magnets 605 and poled so as to oppose their stray flux, provides an easy means of cancelling the undesired effect. FIG. 12C shows a partial view of the improved shunt reluctance device: to the original device consisting of high-permeability cylinders 601 and 603 and radial magnets 605, another set of radially poled magnets 607 has been added, attached to the inside surface of cylinder 601. It has been found that if magnets 607 are made of the same material and have the same thickness as magnets 605, their width should be about one quarter of the width of magnets 605. Magnets 607 cancel the stray field of magnets 605 without otherwise affecting the operation of the shunt reluctance device described in connection with FIG. 12A.

In one experimental form of the device shown in FIG. 12C, the two high-permeability cylinders 601 and 603 were actually cones, shaped to follow the flare of the cathode ray tube funnel. The cone semi-angle was 21 degrees. Main magnets 605 were trapezoidal strips of flexible plastic only 0.010″ thick, filled with neodymium iron power, 0.230″ wide at the narrow end of the cone and 0.260″ wide at the wider end. Stray field cancelling magnets 607 were made of the same material, 0.010″ thick and 0.060″ wide.

To cancel the stray field inside cylinders or cones 601 and 603, cancelling magnets 607 need not be arranged on the inside of cylinder or cone 601. The same effect may be obtained by attaching slightly larger or stronger magnets to the outside of cylinder or cone 603.

Figure 12D:
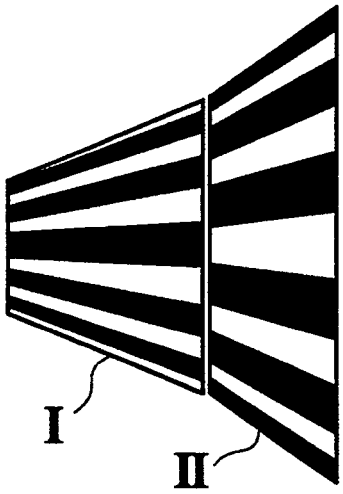

FIG. 12D shows schematically another arrangement for cancelling the undesirable stray field of the device illustrated in FIG. 12A. Here, a flared form of the device is divided into two sections I and II. Magnets 605 in the two sections are reversed with respect to each other; in the figure, white stripes indicate north poles facing outward, black stripes designate north poles facing inward. The effect upon the electron beams produced by stray fields in the magnets of section I is cancelled by the effect produced in section II. The relative axial length of the two sections is chosen so as to optimize cancellation.

Figure 12E:
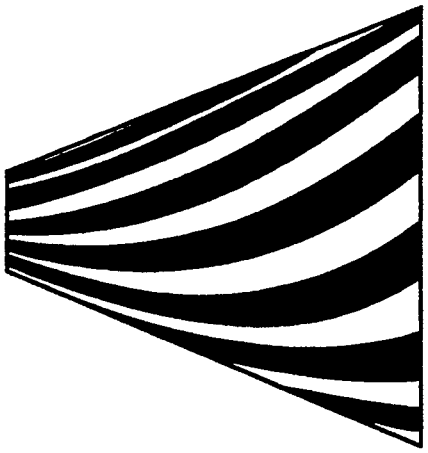

FIG. 12E shows another alternative form of the device of FIG. 12A which achieves cancellation of the stray field effects by arranging the magnets (schematically indicated by the white and black stripes as in FIG. 12D) along helical paths. An electron traveling through this device is sequentially subjected to all possible orientations of the stray field, with the result that the effects of the stray field tend to cancel out.

The shunt reluctance devices exemplified by FIG. 12A, henceforth referred to as shunt rings, have a twofold purpose as was previously explained. When in the presence of a sufficiently strong external field some portions of a shunt ring go out of saturation, the flux change in these portions shunts the external field, thereby weakening the field inside the cathode ray tube and reducing the deflection angle of the electron beams. At the same time, the extra flux path through the previously saturated portions tends to increase the yoke inductance, thus counterbalancing the drop in inductance caused by the increased reluctance of a partly saturated flux return path such as ferrite ring 205 (FIG. 7).

It has been found that in a shunt ring of the kind depicted in FIG. 12A, in the presence of an external uniform field sufficiently strong to cause portions of cylinders 601 and 603 to go out of saturation, the weakened field inside cylinder 601, i.e. in the space provided for the cathode ray tube, does not remain completely uniform. Rather, it is strongest in the center and a few percent weaker near the two desaturated portions. It is well known that minimum size and optimum shape of the focused spots produced by the electron beams is obtained when the deflection field is uniform; it has indeed been observed that the spot size and shape produced with uniform field deflection windings containing the shunt ring depicted in FIG. 12A is not as good as that obtained with the same windings when the shunt ring is removed.

All shunt rings discussed up to this point are symmetrical: they make use of two parallel flux paths saturated by flux flowing in opposite directions. This is necesary if an external field is to cause desaturation on both sides of the cathode ray tube, thus producing a weakened field which is at least symmetrical if not perfectly uniform. Unexpected advantages, however, may be obtained with the asymmetrical shunt ring shown schematically in FIG. 12F which has only one flux path. An upward-directed external field is shown, and saturation flux 950—which may be produced by a toroid winding carrying d.c., or by inserting magnets in series with a high-permeability cylinder, as schematically illustrated in each of the two cylinders shown in FIG. 11—flows counterclockwise. The figure represents a view from the screen side of the cathode ray tube.

Figure 12F:
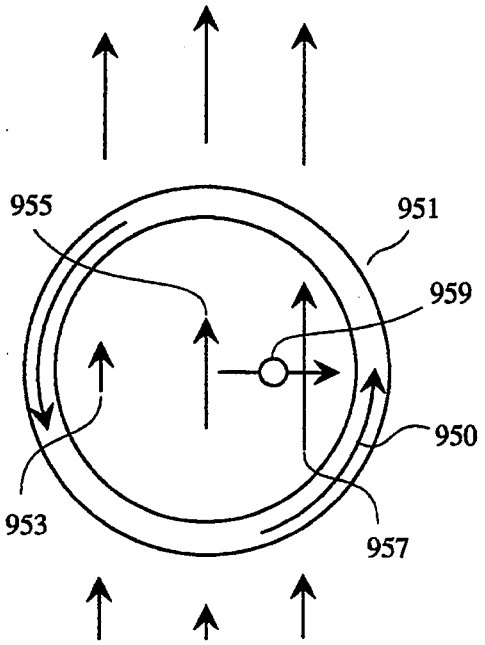

In FIG. 12F, the upward-directed external field desaturates the left-hand portion of cylinder 951 but has no effect on its right-hand portion which remains saturated. Therefore, the field inside, denoted by arrows 953, 955 and 957, is greatly weakened on the left (arrow 953), less weakened in the center (arrow 955) and even less weakened on the right (arrow 957). The electron beam 959 is deflected to the right along deflection axis 960, into the region of the strongest field.

If the external field were now reversed, the right side would desaturate and the strongest field would be to the left. At the same time, the electron beam would be deflected to the left, again in the direction of the strongest field. Indeed, the circular symmetry of the saturated cylinder ensures that no matter at what angle to the vertical the external field is directed, the beam will always be deflected toward the region of the strongest field. This remains true so long as the flux in the cylinder runs counterclockwise as seen from the screen.

Measurement of the intensity of fields 953, 955 and 957 shows that the decrease of field strength with distance from the desaturated portion of cylinder 951 is highly linear. It has been found that with such an asymmetric shunt ring substituted for the symmetrical shunt ring of FIG. 12A, the quality and size of the focused spots comes very close to that obtained with an unmodified uniform field yoke. The asymmetric shunt ring must, of course, be designed so that it still performs the two functions mentioned above, i.e. reducing the deflection angle of the electron beams and increasing the yoke inductance.

Figure 12G:
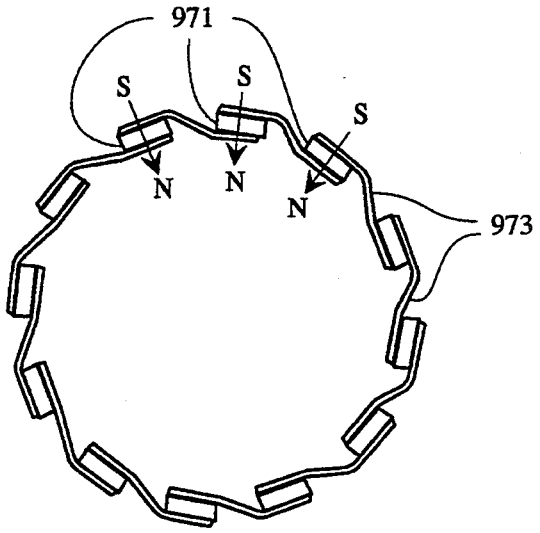

FIG. 12G shows a practical form of the asymmetric shunt ring which has given excellent experimental results. Twelve permanent magnets 971, each forming a rectangle 0.200" by 0.800" with the latter dimension parallel to the axis of the device, are arranged magnetically in series, evenly spaced around a circle. They are interconnected by thin strips 973 of high-permeability material also 0.800" wide. Magnets 971 are only 0.010" thick and are made of flexible plastic loaded with neodymium iron powder. They are poled radially, all in the same direction as shown. The completed device forms a thin-walled cylinder which is inserted between the tube neck and the gun end of the deflection yoke, care being taken to ensure correct polarity of the magnetic flux encircling the tube neck.

In practice, the cylindrical, asymmetric shunt ring just described is used in combination with the conical, symmetrical shunt ring having a 21 degree semi-angle of flare which was described earlier in connection with FIG. 12C. It has been found that the sensitivity to the stray fields of the individual magnets is greatest in the flared portion of the yoke; therefore, the flared shunt ring is equipped with stray field compensating magnets 607. While, in this embodiment, the asymmetric and symmetrical shunt rings have approximately equal axial length, that ratio may be varied; it is, for example, possible to use the asymmetric design throughout in order to take advantage of the the favorable effect of this design upon the convergence of the three electron beams. Stray field compensating magnets analogous to magnets 607 shown in FIG. 12C may be used to suppress the stray fields of magnets 971.

There is an advantage to be gained from dividing the shunt ring into two separate parts, i.e. a cylindrical or near-cylindrical portion at the gun end of the yoke and a strongly flared portion closer to the sceen end. It must be remembered that a shunt ring by itself, being magnetically saturated, has no effect on the shape of the raster; the ring becomes effective only when it is subjected to the deflection fields produced by the yoke coils, i.e. when it is inside the yoke windings. The magnitude of the effect of a shunt ring may therefore be adjusted by moving the ring axially into or out of these windings.

Figure 12H:
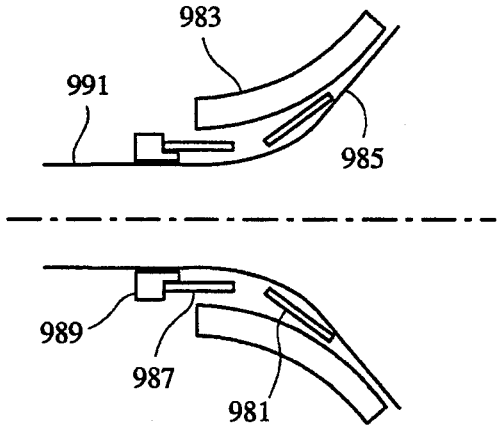

According to the invention, an axially movable shunt ring is provided in addition to at least one permanently positioned flared shunt ring, and the rings are designed so as to overcompensate slightly for pincushion distortion when the movable ring is completely inside the yoke windings. Fine adjustment of the raster shape for best rectangularity may then be achieved by adjusting the axial position of the movable shunt ring. Such an arrangement is schematically illustrated in FIG. 12H:

flared shunt ring 981 is permanently positioned in the narrow space between yoke windings 983 and funnel 985 of the cathode ray tube. Cylindrical shunt ring 987 is mounted on a plastic clamp 989 which can be moved axially along tube neck 991, thereby permitting adjustment of the depth to which shunt ring 987 penetrates into the magnetic field of the yoke windings.

It is preferred to combine the series and shunt reluctance forms of the invention. With such a combination, the effects of series and shunt reluctance upon the inductance of the windings tend to cancel, while their effects of producing a less-than linear increase of the field inside the neck with respect to increasing deflection currents enhance each other.

Figure 13:
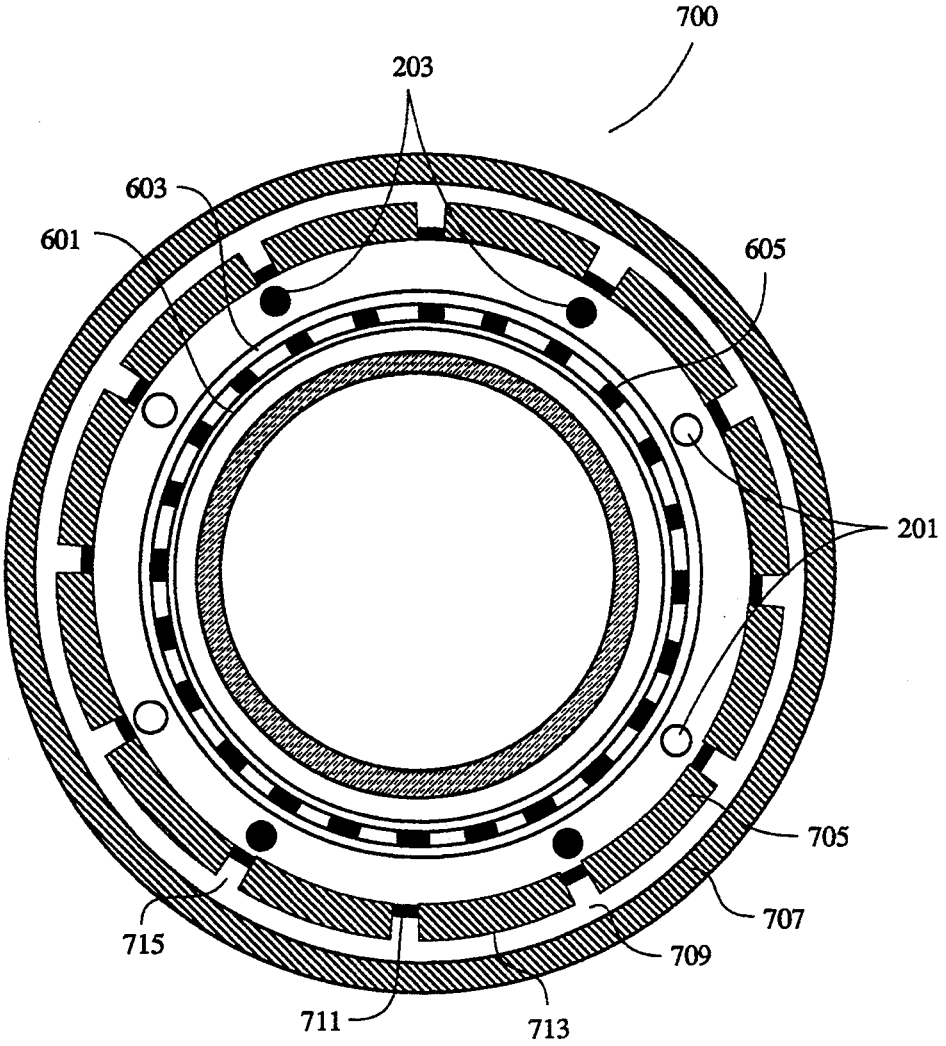
FIGS. 13, 14A and 14B illustrate still another embodiment employing the combination of series reluctance means and shunt conductance means to satisfy the objectives of the invention.
Figure 14A:
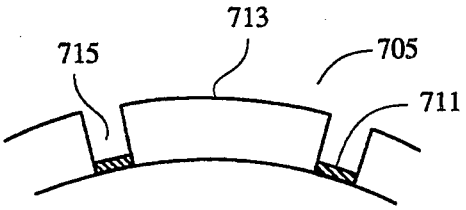
Figure 14B:
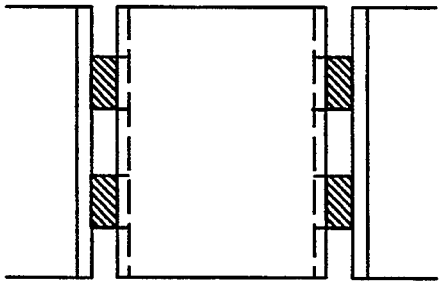

The series reluctance features of FIG. 7 are combined with the shunt reluctance features of FIG. 12A in the device illustrated in FIG. 13 and FIGS. 14A–14B. The method of operation of the two forms of the invention was explained in connection with the earlier figures. In the system shown in FIG. 13, the two subsystems operate simultaneously. The dimensions given below are suitable for a 29 mm tube neck diameter.

Deflection fields are generated by currents $I_H$ in horizontal windings 201 and $I_v$ in vertical winding 203 of yoke 700. The shunt reluctance portion is located in the space enclosed by windings 201 and 203 and comprises two concentric ferrite cylinders 601 and 603, spaced from each other by a concentric gap about 0.020" wide. The ferrite cylinders have a wall thickness of about 0.016". Twenty-four permanent magnets 605 are uniformly spaced around the circumference of the cylindrical gap, adjacent magnets being alternately poled north outward and north inward. The magnets are about 0.080" wide, 0.020" thick and extend along the full axial length of cylinders 601 and 603. They are characterized by a remanent flux density of about 2000 gauss and a permeability very close to unity in gauss/oersted units.

The series reluctance portion is located in the space outside windings 201 and 203. It comprises two concentric annular pieces 705 and 707 separated by an annular gap 709. Pieces 705 and 707 function in a manner similar to cylinders 205 and 207 described in the context of FIG. 7 but there are important differences. With a neck as small as 29 mm, the total return flux is so small that to saturate at the desired level of about 30 gauss in the tube neck, the inner cylinder 205 of FIG. 7 would have to be no thicker than about 0.010" to 0.015". This is undesirable for a number of reasons. In FIG. 13, the inner cylinder 705 is shown segmented; FIG. 14A shows a short portion of cylinder 705 in side view and FIG. 14B gives a top view. There are twelve segments around the circumference; each segment comprises a short portion 711 of very small cross-section and a longer portion 713 of much larger cross-section. Only portions 711 saturate when the total flux reaches a predetermined value; portions 713 retain their low reluctance. The point of saturation can be controlled and the approach to saturation made more gradual by tailoring the cross-section of portions 711. After portions 711 have saturated, flux is carried around them by air gap 715. If these gaps are designed to have the appropriate reluctance, outer cylinder 707 becomes unneccessary; it may, however, be desirable to retain it for shielding purposes.

In operation, non-linear yoke 700 is connected to a conventional scanning circuit designed to generate linear sawtooth currents at the horizontal and vertical scanning frequencies when connected to a constant inductance yoke. As previously explained, the two currents combine to produce at a given instant a magnetic field $\sqrt{a^2I_H^2+b^2I_V^2}$ with an angular orientation $\phi$ inside the tube neck. So long as this field remains small, narrow portions 711 of segmented cylinder 705 do not saturate, and pre-magnetized cylinders 601 and 603 remain saturated; the value of flux density inside the tube neck is proportional to the applied field and is very close to the value that would prevail if portions 711 were not narrow and cylinders 601 and 603 did not exist. But as the deflection currents increase, portions 711 approach saturation, so that their reluctance begins to increase; at the same time, portions of cylinders 601 and 603 are driven out of saturation and begin to shunt some flux away from the tube neck. Both of these processes slow down the increase of the field inside the tube neck. At the same time, the increasing reluctance of portions 711 tends to reduce the inductance of the yoke windings, while the increasing shunting action of cylinders 601 and 603 tends to increase it by providing additional flux paths. As a consequence, the inductance remains substantially unchanged, as required by the driving circuit.

Figure 15:
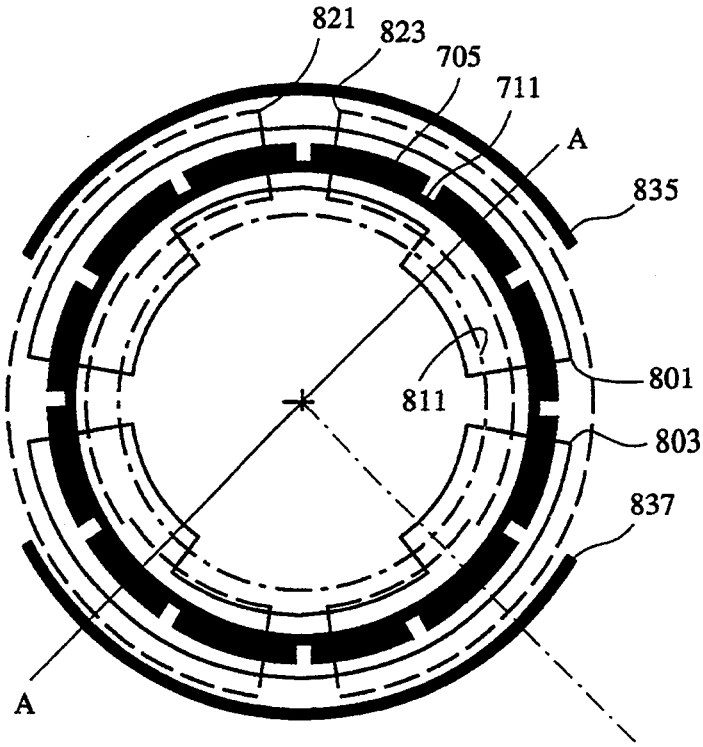
FIGS. 15–19 illustrate additional embodiments of the invention.
Figure 16:
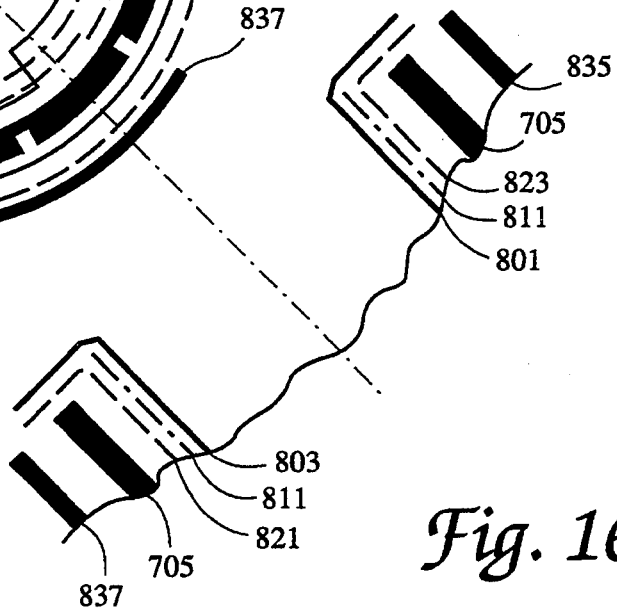

It was previously explained that a deflection yoke according to this invention is characterized by circular symmetry. This implies symmetry of the magnetic characteristics between vertical and horizontal windings. The required symmetry is easily achieved in so-called stator yokes where both windings are laid into radial slots on the inside of an annular ferrite core. More commonly, however, conventional yokes are constructed with the two windings radially separated by an insulating layer. FIGS. 15 and 16 show a yoke according to the invention, with its windings constructed in the conventional manner just described. FIG. 15 is a side view, while FIG. 16 is a section through the plane A—A indicated in FIG. 15.

A pair of saddle-shaped coils 801–803, positioned to produce a vertical magnetic field for horizontal deflection of the electron beams, is arranged on the inside of a plastic liner 811. Outside the plastic liner there is a second pair of saddle-shaped coils 821 and 823, positioned to produce a horizontal magnetic field for vertical deflection of the electron beams. In a conventional yoke, a heavy ferrite ring of a cross section sufficient to avoid saturation at all operating currents would be arranged around coils 821 and 823.

According to the invention, a ferrite ring 705 having a reduced cross section and comprising short portions 711 whose cross section is even smaller, is substituted for the conventional heavy ferrite ring. The mode of operation of ring 705, which provides an increase in series reluctance at high deflection currents, was explained in connection with FIGS. 7 and 13. However, combining this ring with the conventional, radially separated windings creates a problem: vertical deflection coils 821 and 823, being substantially closer to ferrite ring 705 than horizontal deflection coils 801 and 803, are more strongly influenced by its nonlinear magnetic characteristics than the horizontal deflection coils. It takes less ampere turns in coils 821 and 823 to saturate portions 711 than in coils 801 and 803. Circular symmetry is thus compromised.

Figure 17:
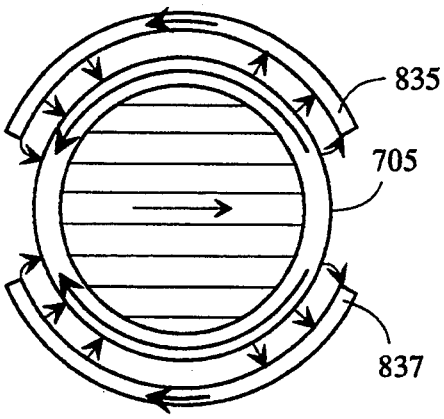

Compensation for this undesired effect is obtained with the structure shown in FIGS. 15 and 16, through the addition of arcuate high-permeability elements 835 and 837. FIG. 17 shows the field distribution produced by windings 821 and 823 for a high-current condition which produces saturation in portions 711 (not shown in this figure) of ferrite ring 705. The arrows indicate the directions of magnetic flux in various parts of the structure. Flux is seen to leak out of ring 705 on the right side, on top as well as on the bottom; this flux finds a ready path through arcuate elements 835 and 837 over to the left side of the structure, where it leaks back into the ring 705.

It can be seen that arcuate elements 835 and 837 provide extra cross section in the return path for the horizontal flux generated by windings 821 and 823. Since the total flux produced by these windings is limited by the reluctance of the air gap, i.e. the cylindrical space inside the yoke, the availability of an additional return path tends to delay the onset of saturation, thus compensating for the close spacing of the windings from ring 705 which would otherwise saturate too early.

Figure 18:
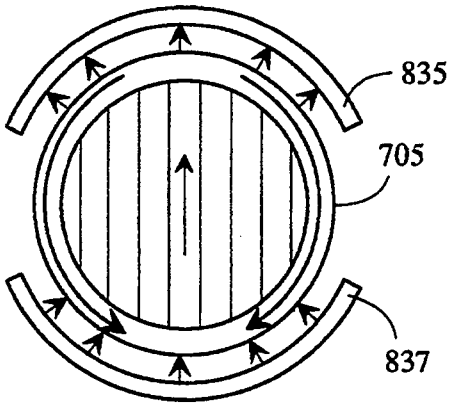
Figure 19:
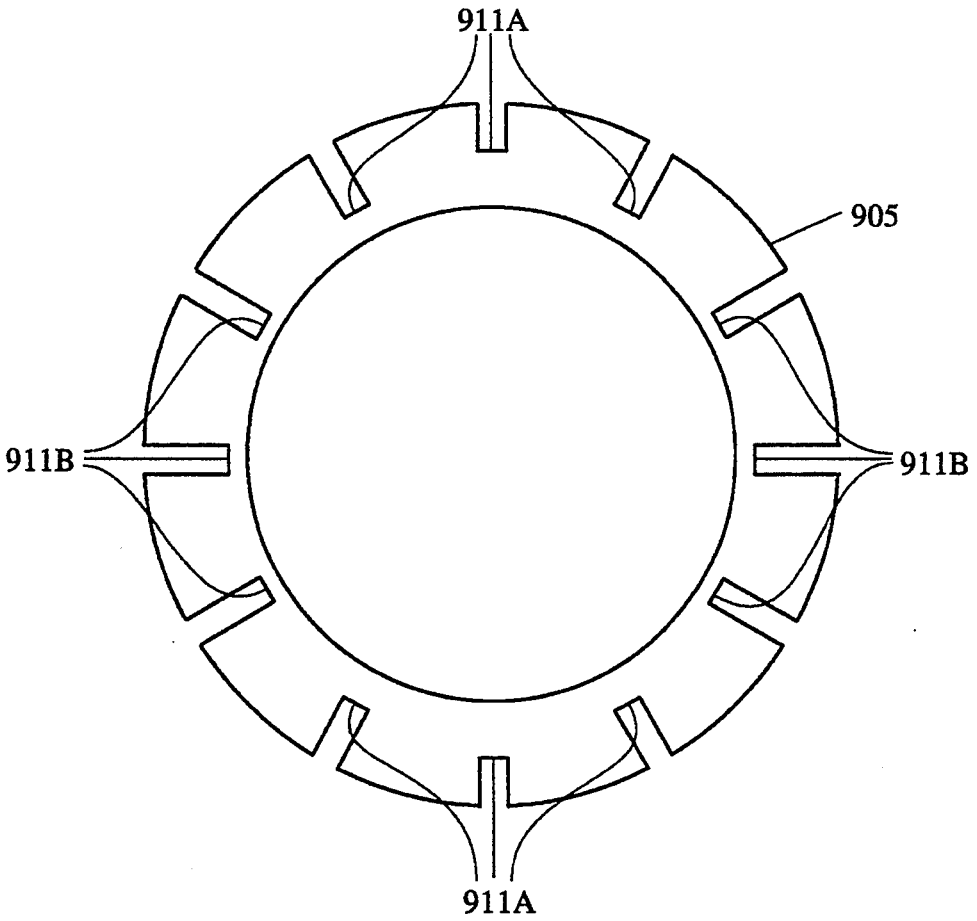

FIG. 18 depicts the flux pattern produced by windings 801 and 803 which generate a vertical field for horizontal beam deflection. Again, a high-current condition is assumed, so that saturation is produced in portions 711 (not shown in this figure) of ring 705. Again, flux is leaking out of ring 705 toward arcuate elements 835 and 837. However, this time all flux lines extending toward element 835 point outward and all flux lines extending toward arcuate element 837 point inward. Therefore, the arcuate elements cannot carry flux between regions of opposite polarity, thus cannot provide extra cross section in the return path, and the saturation characteristics of windings 801 and 803 remain unchanged.

The angle covered by arcuate elements 835 and 837 may vary, depending on the detailed construction of the windings. An angle of about 120 degrees has been found to produce good compensation. In this case, each of the gaps between the two elements spans an angle of about 60 degrees.

A plurality of arcuate elements 835, 827 may be needed to provide optimum compensation. In connection with FIG. 6, which illustrates a saturable ferrite core consisting of two concentric pieces 205 and 207 separated by an annular air gap 209, it was mentioned that to obtain a more gradual onset of saturation, the core may be split into more than two annular portions separated by more than one air gap. A plurality of arcuate element pairs 835, 837 may be distributed in such air gaps in any desired fashion to obtain optimum symmetry of the saturation characteristics of the horizontal and vertical windings.

Arcuate elements 835, 837 may also be combined with high-permeability rings 705 to form rings of variable cross section, with those segments corresponding to the arcuate elements widened to provide the extra flux path. FIG. 17 shows an example of such a structure; ferrite ring 905, the equivalent of ring 705 in FIG. 13, is modified in that its narrow portions 911, unlike portions 711 in FIG. 13, do not all have the same cross section. Instead, portions 911A, located where arcuate elements 835 and 837 would normally be deployed, have a larger cross section than portions 911B. As a result, the flux required to saturate those segments of ring 905 comprising portions 911A is greater than that needed to saturate the segments containing portions 911B. By tailoring the cross sections in accordance with the meachnical layout of the two windings, symmetry in the saturation characteristics of the windings may be restored.

It will be understood that any of the series reluctance forms of the invention, such as those shown in FIGS. 6A, 7, 8, 14A and 14B or 15–19, or any of the shunt reluctance forms, such as those shown in FIGS. 4, 11, 12A or 12C–12E, and 12F–12H, may be used individually or any one of each type combined with any one of the other type.

While the invention has been described in terms of a uniform field yoke in the interest of easier analysis, it will be understood that the same principles may be applied and the same devices may be adapted to yokes designed to generate non-uniform fields.

The invention has been illustrated and described in the context of a yoke and system for compensating for geometrical image distortions resulting from the combined horizontal and vertical yoke fields, however, one skilled in the art will appreciate that the principles herein described are useful in compensating for distortions produced by one or the other of the yoke fields.

While particular embodiments of the present invention have been shown and described, it is apparent that changes and modifications may be made herein without departing from the invention in its broader aspects. The aim of the appended claims, therefore, is to cover all such changes and modifications as fall within the true spirit and scope of the invention.

What is claimed is:

1. An improved cathode ray tube yoke assembly capable of reducing or eliminating cathode ray tube geometrical image distortions caused by an inherent super-linear relationship between magnetic deflection fields inside the tube and electron beam spot deflection, said yoke assembly comprising:

horizontal and vertical windings for producing horizontal and vertical deflection fields; and magnetic means including series reluctance means constructed and arranged to saturate as horizontal and vertical deflection currents increase, increasing the total reluctance in the horizontal and vertical magnetic deflection field paths such that said magnetic means has sub-linear magnetic properties which at least partially compensate for said inherent super-linear relationship between said magnetic deflection fields and said electron beam spot deflection.

2. The yoke assembly defined by claim 1 wherein said series reluctance means comprises means located within said horizontal and vertical windings and having a plurality of radial portions of constricted cross-section within which said saturation occurs.

3. The yoke assembly defined by claim 1 wherein said series reluctance means includes a first series reluctance means situated within said deflection fields of said horizontal and vertical windings and having a greater influence on a first of said deflection fields than on the other of said fields, and second series reluctance means constructed and arranged to influence the said other of said fields more than said first field to compensate for said greater influence of said first reluctance means.

4. The yoke assembly defined by claim 3 wherein said first reluctance means comprises a ring of magnetic material.

5. The yoke assembly defined by claim 4 wherein said second reluctance means comprises diametrically opposed angular magnetic means radially spaced from said ring.

6. The yoke assembly defined by claim 4 wherein said second reluctance means comprises diametrically opposed radial extensions of said ring.

7. The yoke assembly defined by claim 1 wherein said series reluctance means comprises annular means having angularly spaced portions of azimuthally constricted cross-section within which said saturation occurs.

8. An improved cathode ray tube yoke assembly capable of reducing or eliminating cathode ray tube geometrical image distortions caused by an inherent non-linear relationship between a magnetic deflection field inside the tube and electron beam spot deflection, said yoke assembly comprising:

horizontal and vertical windings for producing horizontal and vertical deflection fields; and magnetic means in series with the field of a yoke winding, said magnetic means comprising along a radial of said yoke assembly an effective plurality of high permeability magnetic members arranged to saturate in cascade with increasing magnetic field to produce a non-linear relationship between horizontal and vertical driving currents and magnetic deflection fields inside the tube effective to at least partially compensate for said inherent non-linear relationship between said deflection field and electron beam spot deflection.

9. The yoke defined by claim 8 wherein said effective plurality of magnetic members comprises a series of concentric rings of magnetic materials surrounding said windings.

10. The yoke defined by claim 8 wherein said effective plurality of magnetic members comprises a spiral of magnetic material wound around said windings.

11. An improved cathode ray tube yoke assembly capable of reducing or eliminating cathode ray tube geometrical image distortions caused by an inherent non-linear relationship between a magnetic deflection field inside the tube and electron beam spot deflection, said yoke assembly comprising:

horizontal and vertical windings for producing horizontal and vertical deflection fields; and magnetic means including parallel magnetic conductance means biased to saturation at zero deflection field and constructed and arranged to desaturate and to shunt deflection field flux as horizontal and vertical deflection currents increase, such that said magnetic means has non-linear magnetic properties for at least partially compensating for said inherent non-linear relationship between said magnetic deflection field inside the tube and electron beam spot deflection.

12. The yoke assembly defined by claim 11 wherein said conductance means includes first magnetomotive force means which creates undesired stray magnetic fields introducing electron beam trajectory errors, said yoke assembly including correction magnetomotive force means constructed and arranged to create opposing magnetic fields at least partially offsetting said stray magnetic fields.

13. The yoke assembly defined by claim 12 wherein said correction magnetomotive force means is radially aligned with said first magnetomotive force means.

14. The yoke assembly defined by claim 11 wherein said magnetic means includes at least one magnetic member and biasing means for biasing said magnetic member to or near saturation, said magnetic member desaturating to shunt deflection flux away from the beam-influencing region within said tube as deflection current in said windings increases.

15. The yoke assembly defined by claim 14 wherein said magnetic member is a ring, and wherein, as said deflection current increases, deflection flux at one end of the deflection axis decreases due to said desaturation effect while the deflection flux at the opposed end of the deflection axis decreases substantially less, thus producing a flux gradient along said deflection axis.

16. The yoke assembly defined by claim 15 wherein said magnetic member comprises an array of evenly angularly spaced permanent magnets, radially poled and interconnected tangentially, north pole to south, by magnetic bridges.

17. The yoke assembly defined by claim 11 wherein said conductance means includes magnetomotive force means which creates undesired stray magnetic fields capable of causing electron beam trajectory errors, said magnetomotive force means comprising axially displaced portions which present to a passing beam stray fields of opposed polarity such that effects of said stray fields produced by said different portions tend to be offsetting.

18. The yoke assembly defined by claim 17 wherein said portions are rotationally offset.

19. The yoke assembly defined by claim 17 wherein said magnetomotive force means has a helical configuration relative to the axis of the yoke assembly.

20. An improved cathode ray tube yoke assembly capable of reducing or eliminating cathode ray tube geometrical image distortions caused by an inherent super-linear relationship between magnetic deflection fields inside the tube and the electron beam spot deflection, said yoke assembly comprising:

horizontal and vertical windings for producing horizontal and vertical deflection fields; and magnetic means including parallel magnetic conductance means simultaneously biased to or near saturation in opposite directions at zero deflection field, said magnetic means desaturating to shunt deflection field flux from the beam-influencing region within said tube as deflection current increases in said windings in either polarity, whereby a sub-linear relationship is produced between the driving currents for said windings and the magnetic deflection fields produced by said winding within said beam-influencing region for at least partially compensating for said inherent non-linear relationship between said deflection fields and said electron beam spot deflection.

21. An improved cathode ray tube yoke assembly capable of reducing or eliminating cathode ray tube geometrical image distortions caused by an inherent super-linear relationship between magnetic deflection fields inside the tube and the electron beam spot deflection, said yoke assembly comprising:

horizontal and vertical windings for producing horizontal and vertical deflection fields; and non-linear magnetic means located within a yoke winding and situated magnetically in parallel with a deflection field of said winding for producing a sub-linear relationship between the driving current in said winding and the magnetic deflection field within said beam-influencing region produced thereby for at least partially compensating for said inherent super-linear relationship between said deflection field and said electron beam spot deflection.

22. The yoke assembly defined by claim 21 wherein said magnetic means includes first and second high permeability magnetic members biased to or near saturation in opposite directions at zero deflection field, said first magnetic member desaturating to shunt deflection flux away from the beam-influencing region within said tube as deflection current in said windings increases in one polarity, and said second member desaturating to shunt deflection flux as deflection current in said winding increases in the opposite polarity.

23. The yoke assembly defined by claim 22 wherein said first and second magnetic members comprise concentric rings of magnetic material.

24. The yoke assembly defined by claim 23 wherein said first and second magnetic members are oppositely biased to saturation by respectively oppositely poled magnetomotive force means.

25. The yoke assembly defined by claim 24 wherein said magnetomotive force means are electromagnetic coils.

26. The yoke assembly defined by claim 24 wherein said magnetomotive force means are permanent magnets.

27. The yoke assembly defined by claim 22 wherein said first and second magnetic members comprise segments of concentric rings of magnetic material, and wherein said rings are intercoupled by angularly spaced, radially oriented, alternately oppositely poled magnetomotive force means creating angularly spaced flux loops through said first and second magnetic members such that said desaturation occurs along interwoven sinuous paths interconnecting said first and second magnetic members.

28. The yoke assembly defined by claim 21 wherein said magnetic means includes at least one magnetic member and biasing means for biasing said magnetic member to or near saturation, said magnetic member desaturating to shunt deflection flux away from the beam-influencing region within said tube as deflection current in said windings increases.

29. The yoke assembly defined by claim 28 wherein said magnetic member is a ring, and wherein, as said deflection current increases, deflection flux at one end of the deflection axis decreases due to said desaturation effect while the deflection flux at the opposed end of the deflection axis decreases substantially less, thus producing a flux gradient along said deflection axis.

30. The yoke assembly defined by claim 29 wherein said magnetic member comprises an array of evenly angularly spaced permanent magnets, radially poled and interconnected tangentially, north pole to south, by magnetic bridges.

31. An improved cathode ray tube yoke assembly capable of reducing or eliminating cathode ray tube geometrical image distortions caused by an inherent non-linear relationship between magnetic deflection fields inside the tube and electron beam spot deflection, said yoke assembly comprising:

horizontal and vertical windings for producing horizontal and vertical deflection fields; and magnetic means including parallel magnetic conductance means biased to saturation at zero deflection fields and constructed and arranged to desaturate and to shunt deflection field flux as horizontal and vertical deflection currents increase, such that said magnetic means has non-linear magnetic properties for at least partially compensating for said inherent non-linear relationship between said magnetic deflection fields inside the tube and electron beam spot deflection, said magnetic means including an electromagnetic member saturable by application of current from an external current source, said current source being adjustable to optimize said compensation.

32. An improved cathode ray tube yoke assembly capable of reducing or eliminating cathode ray tube geometrical image distortions caused by an inherent super-linear relationship between magnetic deflection fields inside the tube and electron beam spot deflection, said yoke assembly comprising:

horizontal and vertical windings for producing horizontal and vertical deflection fields; and magnetic means having sub-linear magnetic properties for compensating for said inherent super-linear relationship between said deflection fields and said electron beam spot deflection, said magnetic means comprising series reluctance means constructed and arranged to saturate as horizontal and vertical deflection currents increase and thereby to increase the total reluctance in the horizontal and vertical magnetic deflection field paths, said magnetic means further including parallel conductance means biased to saturation at zero deflection fields and constructed and arranged to desaturate and to shunt deflection field flux as horizontal and vertical deflection currents increase.

33. The yoke assembly defined by claim 32 wherein said parallel conductance means comprises first and second segments of high permeability magnetic rings biased to or near saturation in opposite directions at zero deflection field, said first segments desaturating to shunt deflection flux away from the beam-influencing region within said tube as deflection current in said winding increases in one polarity, and said second segments desaturating to shunt deflection flux as deflection current in said winding increases in the opposite polarity.

34. The yoke assembly defined by claim 33 wherein said series reluctance means comprises an annular magnetic member having constricted portions wherein saturation occurs.

35. The yoke assembly defined by claim 33 wherein said series reluctance means comprises along a radial of said yoke assembly an effective plurality of high permeability magnetic members arranged to saturate in cascade with increasing magnetic field.

36. The yoke assembly defined by claim 32 wherein said parallel conductance means comprises first and second magnetic members in the form of concentric rings of magnetic material, and wherein said rings are intercoupled by angularly spaced, radially oriented, alternately oppositely poled, magnetomotive force means creating angularly spaced flux loops through said first and second magnetic members such that desaturation occurs along interwoven sinuous paths interconnecting said first and second magnetic members.

37. The yoke assembly defined by claim 36 wherein said series reluctance means comprises along a radial of said yoke assembly an effective plurality of high permeability magnetic members arranged to saturate in cascade with increasing magnetic field.

38. The yoke assembly defined by claim 32 wherein said magnetic means is constructed and arranged so that the decrease in inductance at high winding currents caused by said series reluctance means is substantially compensated by the increase in inductance produced by said parallel conductance means.

39. The yoke assembly defined by claim 32 wherein said series reluctance means includes a first series reluctance means situated within said deflection fields of said horizontal and vertical windings and having a greater influence on a first of said deflection fields than on the other of said fields, and second series reluctance means constructed and arranged to influence the said other of said fields more than said first field to compensate for said greater influence of said first reluctance means.

40. The yoke assembly defined by claim 39 wherein said first reluctance means comprises a ring of magnetic material.

41. The yoke assembly defined by claim 40 wherein said second reluctance means comprises diametrically opposed angular magnetic means radially spaced from said ring.

42. The yoke assembly defined by claim 40 wherein said second reluctance means comprises diametrically opposed radial extensions of said ring.

43. The yoke assembly defined by claim 32 wherein said conductance means includes first magnetomotive force means which creates undesired stray magnetic fields introducing electron beam trajectory errors, said yoke assembly including correction magnetomotive force means constructed and arranged to create opposing magnetic fields at least partially offsetting said stray magnetic fields.

44. Yoke assembly defined by claim 43 wherein said correction magnetomotive force means is radially aligned with said first magnetomotive force means.

45. The yoke assembly defined by claim 32 wherein said parallel conductance means includes at least one magnetic member and biasing means for biasing said magnetic member to or near saturation, said magnetic member desaturating to shunt deflection flux away from the beam-influencing region within said tube as deflection current in said windings increases.

46. The yoke assembly defined by claim 45 wherein said magnetic member is a ring, and wherein, as said deflection current increases, deflection flux at one end of the deflection axis decreases due to said desaturation effect, but the deflection flux at the opposed end of the deflection axis decreases substantially less, thus producing a flux gradient along said deflection axis.

47. The yoke assembly defined by claim 46 wherein said magnetic member comprises an array of evenly angularly spaced permanent magnets, radially poled and interconnected tangentially, north pole to south, by magnetic bridges.

48. The yoke assembly defined by claim 32 wherein said series reluctance means comprises annular means having angularly spaced portions of azimuthally constricted cross-section within which said saturation occurs.

49. The yoke assembly defined by claim 32 wherein said conductance means includes magnetomotive force means which creates undesired stray magnetic fields capable of causing electron beam trajectory errors, said magnetomotive force means comprising axially displaced portions which present to a passing beam stray fields of opposed polarity such that effects of said stray fields produced by said different portions tend to be offsetting.

50. The yoke assembly defined by claim 49 wherein said portions are rotationally offset.

51. The yoke assembly defined by claim 49 wherein said magnetomotive force means has a helical configuration relative to the axis of the yoke assembly.

52. Cathode ray tube yoke means comprising:

horizontal and vertical windings for producing horizontal and vertical deflection fields; and non-linear magnetic means constructed and arranged to effect a non-linear relationship between yoke driving currents and deflection fields within a beam-influencing region within the tube, and magnetic means causing said horizontal and vertical deflection windings to present a substantially constant inductance to circuit means driving said windings and wherein said non-linear magnetic means comprises both a series reluctance means and a parallel magnetic conductance means cooperatively acting to produce said non-linear relationship.

53. A cathode ray tube system comprising:

a cathode ray tube having an electron gun for producing one or more electron beams;

yoke means on said cathode ray tube including horizontal and vertical windings for deflecting said beams to produce images on the screen of the cathode ray tube; and means for supplying driving currents to said horizontal and vertical windings;

said yoke means being capable of reducing or eliminating cathode ray tube geometrical image distortions caused by an inherent super-linear relationship between magnetic deflection fields inside the tube electron beam spot deflection, said yoke means including magnetic means having series reluctance means constructed and arranged to saturate as horizontal and vertical deflection currents increase, thereby increasing the total reluctance in the horizontal and vertical magnetic deflection field paths such that said magnetic means has sub-linear magnetic properties which substantially compensate for said inherent super-linear relationship between said magnetic deflection fields and said electron beam spot deflection.

54. The yoke means defined by claim 53 wherein said series reluctance means comprises means located within said horizontal and vertical windings and having a plurality of radial portions of constricted cross-section within which said saturation occurs.

55. The system defined by claim 53 wherein said series reluctance means includes a first series reluctance means situated within said deflection fields of said horizontal and vertical windings and having a greater influence on a first of said deflection fields than on the other of said fields, and second series reluctance means constructed and arranged to influence the said other of said fields more than said first field to compensate for said greater influence of said first reluctance means.

56. The yoke assembly defined by claim 55 wherein said first reluctance means comprises a ring of magnetic material.

57. The yoke assembly defined by claim 56 wherein said second reluctance means comprises diametrically opposed angular magnetic means radially spaced from said ring.

58. The yoke assembly defined by claim 56 wherein said second reluctance means comprises diametrically opposed radial extensions of said ring.

59. The yoke assembly defined by claim 53 wherein said series reluctance means comprises annular means having angularly spaced portions of azimuthally constricted cross-section within which said saturation occurs.

60. A cathode ray tube system comprising:

a cathode ray tube having an electron gun for producing one or more electron beams;

yoke means on said cathode ray tube including horizontal and vertical windings for deflecting said beams to produce images on the screen of the cathode ray tube; and means for supplying driving currents to said horizontal and vertical windings;

said yoke means being capable of reducing or eliminating cathode ray tube geometrical, image distortions caused by an inherent super-linear relationship between magnetic deflection fields inside the tube and electron beam spot deflection, said yoke means including magnetic means in series with the field of a yoke winding, said magnetic means comprising along a radial of said yoke assembly an effective plurality of high permeability magnetic members arranged to saturate in cascade with increasing magnetic field to produce a sub-linear relationship between horizontal and vertical driving currents and magnetic deflection fields inside the tube effective to at least partially compensate for said inherent super-linear relationship between said horizontal and vertical deflection fields and electron beam spot deflection.

61. The yoke defined by claim 60 wherein said effective plurality of magnetic members comprises a series of concentric rings of magnetic materials surrounding said windings.

62. The yoke defined by claim 60 wherein said effective plurality of magnetic members comprises a spiral of magnetic material wound around said windings.

63. A cathode ray tube system comprising:

a cathode ray tube having an electron gun for producing one or more electron beams;

yoke means on said cathode ray tube including horizontal and vertical windings for deflecting said beams to produce images on the screen of the cathode ray tube; and means for supplying driving currents to said horizontal and vertical windings;

said yoke means being capable of reducing or eliminating cathode ray tube geometrical image distortions caused by an inherent super-linear relationship between magnetic deflection fields inside the tube electron and beam spot deflection, said yoke means including magnetic means including parallel magnetic conductance means biased to saturation at zero deflection field and constructed and arranged to desaturate and shunt deflection field flux as horizontal and vertical deflection currents increase, such that said magnetic means has sub-linear magnetic properties for at least partially compensating for said inherent super-linear relationship between said magnetic deflection field inside the tube and electron beam spot deflection.

64. The system defined by claim 63 wherein said magnetic conductance means includes first magnetomotive force means which creates undesired stray magnetic fields introducing electron beam trajectory errors, said system including correction magnetomotive force means constructed and arranged to create opposing magnetic fields at least partially offsetting said stray magnetic fields.

65. The system defined by claim 64 wherein said correction magnetomotive force means is radially aligned with said first magnetomotive force means.

66. The yoke assembly defined by claim 63 wherein said conductance means includes magnetomotive force means which creates undesired stray magnetic fields capable of causing electron beam trajectory errors, said magnetomotive force means comprising axially displaced portions which present to a passing beam stray fields of opposed polarity such that effects of said stray fields produced by said different portions tend to be offsetting.

67. The yoke assembly defined by claim 66 wherein said portions are rotationally offset.

68. The yoke assembly defined by claim 66 wherein said magnetomotive force means has a helical configuration relative to the axis of the yoke assembly.

69. A cathode ray tube system comprising:

a cathode ray tube having an electron gun for producing one or more electron beams;

yoke means on said cathode ray tube including horizontal and vertical windings for deflecting said beams to produce images on the screen of the cathode ray tube; and means for supplying driving currents to said horizontal and vertical windings;

said yoke means being capable of reducing or eliminating cathode ray tube geometrical image distortions caused by an inherent super-linear relationship between magnetic deflection fields inside the tube and electron beam spot deflection, said yoke means including magnetic means including parallel magnetic conductance means simultaneously biased to or near saturation in opposite directions at zero deflection field, said magnetic means desaturating to shunt deflection field flux away from the beam-influencing region within said tube as deflection current increases in said windings in either polarity, whereby a sub-linear relationship is produced between the driving currents for said windings and the magnetic deflection fields produced by said windings within said beam-influencing region for at least partially compensating for said inherent super-linear relationship between said deflection fields and said electron beam spot deflection.

70. A cathode ray tube system comprising:

a cathode ray tube having an electron gun for producing one or more electron beams;

yoke means on said cathode ray tube including horizontal and vertical windings for deflecting said beams to produce images on the screen of the cathode ray tube; and means for supplying driving currents to said horizontal and vertical windings;

said yoke means being capable of reducing or eliminating cathode ray tube geometrical image distortions caused by an inherent super-linear relationship between magnetic deflection fields inside the tube electron beam spot deflection, said yoke means including non-linear magnetic means located within a yoke winding and situated magnetically in parallel with a deflection field of said winding for producing a sub-linear relationship between the driving current in said winding and the magnetic deflection field within said beam-influencing region produced thereby for at least partially compensating for said inherent super-linear relationship between said deflection field and said electron beam spot deflection.

71. The system defined by claim 70 wherein said magnetic means includes first and second high permeability magnetic members biased to or near saturation in opposite directions at zero deflection field, said first magnetic member desaturating to shunt deflection flux away from the beam-influencing region within said tube as deflection current in said winding increases in one polarity, and said second member desaturating to shunt deflection flux as deflection current in said winding increases in the opposite polarity.

72. The system defined by claim 71 wherein said first and second magnetic members comprise concentric rings of magnetic material.

73. The system defined by claim 72 wherein said first and second magnetic members are oppositely biased to saturation by respectively oppositely poled magnetomotive force means.

74. The system defined by claim 73 wherein said magnetomotive force means are electromagnetic coils.

75. The system defined by claim 74 wherein said magnetomotive force means are permanent magnets.

76. The system defined by claim 71 wherein said first and second magnetic members comprise segments of concentric rings of magnetic material, and wherein said rings are intercoupled by angularly spaced, radially oriented, alternately oppositely poled magnetomotive force means creating angularly spaced flux loops through said first and second magnetic members such that said desaturation occurs along interwoven sinuous paths interconnecting said first and second magnetic members.

77. The system defined by claim 70 wherein said magnetic means includes at least one magnetic member and biasing means for biasing said magnetic member to or near saturation, said magnetic member desaturating to shunt deflection flux away from the beam-influencing region within said tube as deflection current in said windings increases.

78. The system defined by claim 77 wherein said magnetic member is a ring, and wherein, as said deflection current increases, deflection flux at one end of the deflection axis decreases due to said desaturation effect, but the deflection flux at the opposed end of the deflection axis decreases substantially less, thus producing a flux gradient along said deflection axis.

79. The system defined by claim 78 wherein said magnetic member comprises an array of evenly angularly spaced permanent magnets, radially poled in like polarity, and interconnected tangentially, north pole to south, by magnetic bridges.

80. A cathode ray tube system comprising:

a cathode-ray tube having an electron gun for producing one or more electron beams;

yoke means on said cathode ray tube including horizontal and vertical windings for deflecting said beams to produce images on the screen of the cathode ray tube; and means for supplying driving currents to said horizontal and vertical windings;

said yoke means being capable of reducing or eliminating cathode ray tube geometrical image distortions caused by an inherent super-linear relationship between magnetic deflection fields inside the tube electron beam spot deflection, said yoke means including magnetic means having sub-linear magnetic properties for compensating for said inherent super-linear relationship between said deflection fields and said electron beam deflection, said magnetic means comprising series reluctance means constructed and arranged to saturate as horizontal and vertical deflection currents increase and thereby to increase the total reluctance in the horizontal and vertical magnetic deflection field paths, said magnetic means further including parallel conductance means biased to saturation at zero deflection fields and constructed and arranged to desaturate and to shunt deflection field flux as horizontal and vertical deflection currents increase.

81. The system defined by claim 80 wherein said parallel conductance means comprises first and second segments of high permeability magnetic rings biased to or near saturation in opposite directions at zero deflection field, said first segments desaturating to shunt deflection flux away from the beam-influencing region within said tube as deflection current in said winding increases in one polarity, and said second segments desaturating to shunt deflection flux as deflection current in said winding increases in the opposite polarity.

82. The yoke system defined by claim 81 wherein said series reluctance means comprises an annular magnetic member having constricted portions wherein saturation occurs.

83. The system defined by claim 81 wherein said series reluctance means comprises along a radial of said yoke assembly an effective plurality of high permeability magnetic members arranged to saturate in cascade with increasing magnetic field.

84. The system defined by claim 80 wherein said parallel conductance means comprises first and second magnetic members in the form of concentric rings of magnetic material, and wherein said rings are intercoupled by angularly spaced, radially oriented, alternately oppositely poled, magnetomotive force means creating angularly spaced flux loops through said first and second magnetic members such that desaturation occurs along interwoven sinuous paths interconnecting said first and second magnetic members.

85. The system defined by claim 84 wherein said series reluctance means comprises along a radial of said yoke assembly an effective plurality of high permeability magnetic members arranged to saturate in cascade with increasing magnetic field.

86. The system defined by claim 84 wherein said magnetic means is constructed and arranged so that a decrease in inductance at high winding currents caused by said series reluctance means is substantially compensated by the increase in inductance produced by said parallel conductance means.

87. The system defined by claim 80 wherein said series reluctance means includes a first series reluctance means situated within said deflection fields of said horizontal and vertical windings and having a greater influence on a first of said deflection fields than on the other of said fields, and second series reluctance means constructed and arranged to influence the said other of said fields more than said first field to compensate for said greater influence of said first reluctance means.

88. The yoke assembly defined by claim 87 wherein said first reluctance means comprises a ring of magnetic material.

89. The yoke assembly defined by claim 88 wherein said second reluctance means comprises diametrically opposed angular magnetic means radially spaced from said ring.

90. The yoke assembly defined by claim 88 wherein said second reluctance means comprises diametrically opposed radial extensions of said ring.

91. The yoke assembly defined by claim 80 wherein said series reluctance means comprises annular means having angularly spaced portions of azimuthally constricted cross-section within which said saturation occurs.

92. A cathode ray tube system comprising:

a cathode ray tube having an electron gun for producing one or more electron beams;

yoke means on said cathode ray tube including horizontal and vertical windings for deflecting said beams to produce images on the screen of the cathode ray tube; and means for supplying driving currents to said horizontal and vertical windings;

said yoke means being capable of reducing or eliminating cathode ray tube geometrical image distortions caused by an inherent super-linear relationship between magnetic deflection fields inside the tube electron beam spot deflection, said yoke means including non-linear magnetic means constructed and arranged to effect a non-linear relationship between yoke driving currents and the magnetic fields produced thereby within a beam-influencing region with the tube, said magnetic means causing said horizontal and vertical deflection windings to present a substantially constant inductance to circuit means driving said windings and wherein said non-linear magnetic means comprises both a series reluctance means and a parallel magnetic conductance means cooperatively acting to produce said super-linear relationship.

* * * * *